US005704245A

United States Patent [19]

McClellan et al.

[11] Patent Number: 5,704,245

[45] Date of Patent: Jan. 6, 1998

[54] PROGRESSIVE FORGING MACHINE WITH INDIVIDUALLY ADJUSTABLE TOOLS

[75] Inventors: Richard J. McClellan, Tiffin; Stanley J. Wasserman, Fremont, both of Ohio

[73] Assignee: The National Machinery Company, Tiffin, Ohio

[21] Appl. No.: 653,668

[22] Filed: May 31, 1996

[51] Int. Cl.[6] ..... B21J 13/00

[52] U.S. Cl. ..... 72/446

[58] Field of Search ..... 72/356, 413, 448, 72/482.1, 482.3, 482.4, 20.1, 100, 446

[56] References Cited

U.S. PATENT DOCUMENTS

| | | | |
|---|---|---|---|
| 3,889,515 | 6/1975 | Grombka | 72/448 |
| 4,354,374 | 10/1982 | Deguchi | 72/448 |
| 4,736,612 | 4/1988 | Russell | 72/448 |
| 4,898,017 | 2/1990 | Hite et al. | 72/356 |

OTHER PUBLICATIONS

Nedschroef/Nedschroef Herentals N.V. Brochure.
Sakamura Parts Former Brochure 1990.
Sakamura Ram Plate Hydraulic Lock System.

*Primary Examiner*—David Jones
*Assistant Examiner*—Rodney Butler
*Attorney, Agent, or Firm*—Pearne, Gordon, McCoy & Granger LLP

[57] ABSTRACT

Apparatus for separately adjusting the shut height of individual tools on a progressive forging machine "on the fly" when the machine is running. The apparatus includes individual load bearing wedge blocks on the slide for supporting associated tool cassettes. Each wedge block is displaced by a secondary wedge-like cam driven by an associated power actuator. The wedge geometry yields a compact, rugged construction. The cassettes are supported by precision located surfaces that allow desired axial adjustment without loss of alignment with opposed dies.

9 Claims, 7 Drawing Sheets

PROGRESSIVE FORGING MACHINE WITH INDIVIDUALLY ADJUSTABLE TOOLS

The invention relates to improvements in progressive forging machines.

PRIOR ART

Progressive forging machines, including so-called formers, are subject to changes in operating conditions that can adversely affect the quality and uniformity of the parts they make. For example, as a machine warms up during use, the "shut height" or spacing between the slide and die breast at front dead center can gradually change and result in production of non-uniform parts. Apart from thermal changes in the machine itself, the conditions of the wire being fed to the machine can change and require different shut height positions.

Attempts have been made to compensate for changing additions by adjusting the front dead center position of the entire slide or by shifting a plate carrying all of the tools, typically on the slide, in one direction or the other parallel to the slide motion. As used hereinafter, movement in the axial direction means movement or adjustment in a direction parallel to slide motion and such usage will typically be in reference to movement or adjustment of tools. A need has existed for a practical and convenient manner for individually adjusting the axial position of the tools so that changing conditions can be separately accounted for at each work station. Particularly on large machines, manual adjustments are quite arduous owing to the size of the components and the size of the wrenches required to make adjustments.

SUMMARY OF THE INVENTION

The invention provides apparatus for individually adjusting the shut height of the tools at each of a plurality of work stations in a progressive forging machine. In the preferred embodiment, the adjustment apparatus is disposed on the slide and includes separate wedge plates for each of the work stations. The wedge plates are each operated by a secondary wedge-like cam power driven by an associated motor and screw assembly. The disclosed construction of the wedge adjustment system is both rugged to withstand repeated forging blows and compact to conveniently fit in the confined space of the slide.

A tool supporting cassette that works with the wedge plate is clamped on the slide with a power operated actuator. The tool cassette is precision located where it is aligned laterally, i.e. radially with the center of the opposed work station on the die breast. The locating function for the tool supporting cassette is performed by surfaces that accommodate axial displacement of the tool cassette produced by the wedge adjustment system without affecting the precision lateral adjustment of the respective cassette with the opposed die center.

The invention allows the tools of each of the work stations to be readily adjusted independently of the tools at the other stations. As a result, when making a particular part, the forging process can be easily modified to improve the quality and uniformity of the part by adjusting the relative positions of the tools at each station. This adjustment process can be used in a general way when a part is originally developed and produced and during subsequent regular production runs where thermal conditions in the forging machine change between start-up and a point of temperature stabilization. Additionally, adjustment can advantageously be made for varying wire conditions or other factors "on the fly", i.e. while the machine is running. Such adjustment can involve any combination of settings as between the tools at the various work stations. Since the adjustments are made by power operated elements, the machine operator is not required to have high physical strength or stamina.

DESCRIPTION OF THE PREFERRED EMBODIMENT

A progressive forging machine or former 10 includes a frame 11 having a fixed die breast or bolster 12 and a slide 13 that reciprocates horizontally towards and away from the die breast. The general arrangement of the machine is similar to that of known machines such as shown in U.S. Pat. No. 4,898,017.

Figure 1:
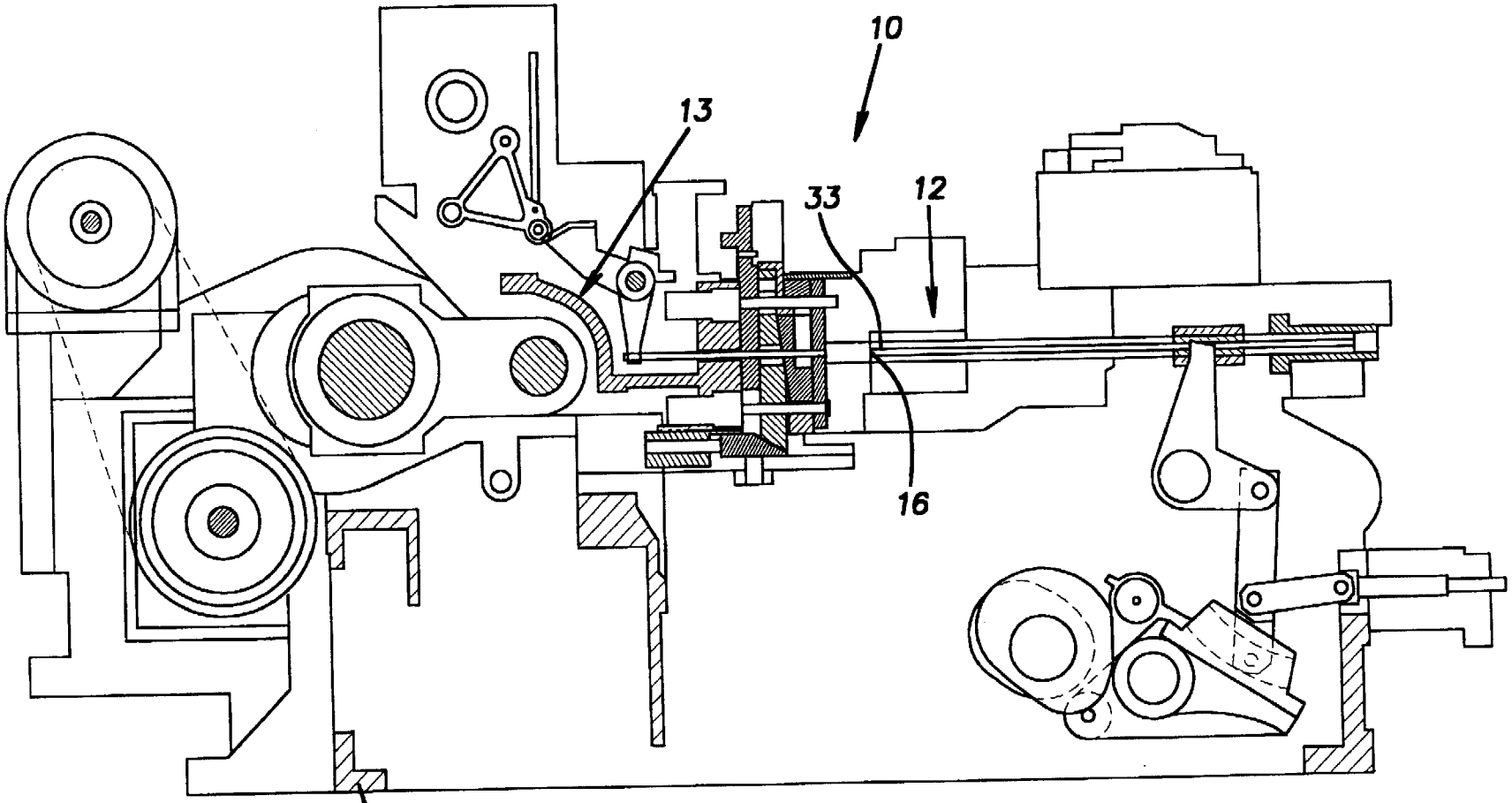
FIG. 1 is a schematic elevational view of a progressive forging machine embodying the invention.
Figure 2A:
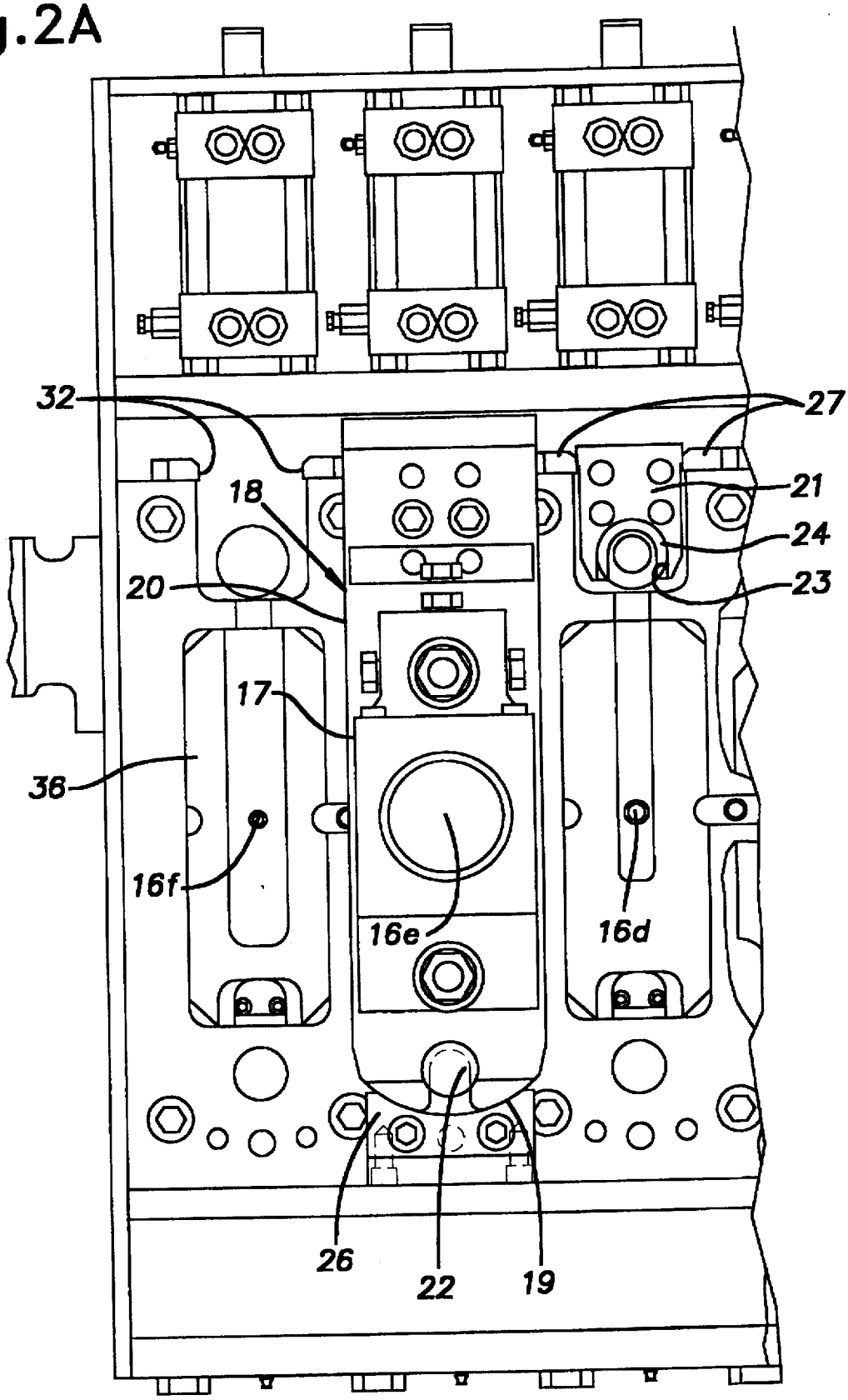
FIGS. 2A and 2B together represent a fragmentary somewhat schematic elevational view of the slide looking in a direction from the die breast.
Figure 2B:
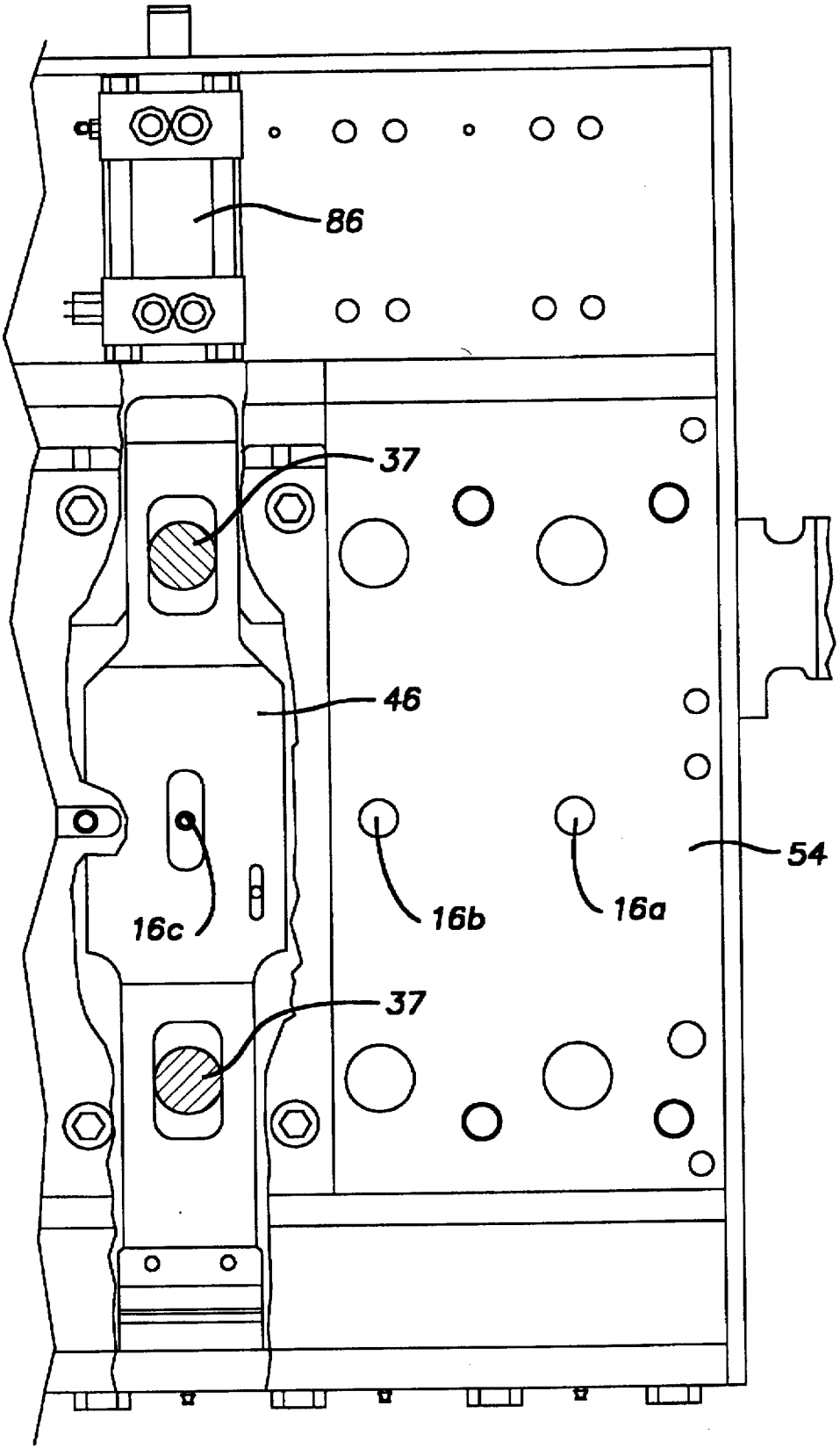

At each work station, indicated generally at 16*a–f*, on the slide 13, there is adapted to be mounted a tool carrier 17, known in the art. Typically, a tool carrier 17 is fixed by bolts to a tool support or cassette 18. The cassette 18 is formed of a vertical plate 20 and a machined, horizontally extending block 21 assembled to the plate by bolts. The cassette 18 has an inverted L-shape in side view and is generally rectangular in front view except for a convex or rounded lower end 19 with a central vertical slot 22. Another central slot 23 exists in the underside of the block 21 forming the upper end 28 of the cassette assembly. An internal shoulder 24 is formed in the slot 23. FIGS. 2A and 2B show various parts, depending on the particular work station being viewed; some parts are broken away or disassembled to show constructional details. At station 16*d* the block 21 is shown with the plate 20 removed.

The cassette 18 is mounted on the slide 13 by lowering it onto a concave saddle 26 at its lower end 19 and between a pair of opposed blocks 27 at its upper end designated 28. A block 29 supporting the saddle or cradle 26 and the opposed blocks 27 are precision machined to dispose a support surface 31 of the cradle 26 and opposed block supporting surfaces 32 at precisely predetermined positions that locate the cassette 18 in alignment with the true center of the opposed die work station 33 on the die breast 12. The surfaces 31 and 32 are parallel to the axial direction of the tool, i.e. parallel to the direction of slide movement.

The cassette 18 is releasably and resiliently held against a wedge block 36 by a pair of clamp bars 37. The bars 37 each include an annular groove 38 that is received in a respective one of the slots 22, 23 and a head 39 that bears against an adjacent surface of the cassette 18 to bias it against the wedge block 36. The wedge block 36 bears the compressive forging load applied by the tool on its associated cassette 18 and transfers this load to the abutting wedge plate 46 which, in turn, transfers it to the slide 13 proper through the plate 54.

The wedge block 36 and an associated wedge plate 46 are received in an associated pocket or cavity 47 machined in a large cage plate 48 rigidly fixed by suitable bolts to the main body of the slide 13. A face 50 of the wedge block 36 in contact with the cassette 18 lies in a vertical plane perpendicular to the axis of the work station. A side or face 51 of the wedge plate 46 remote from the wedge block 36 similarly lies in a vertical plane perpendicular to the axis of the work station. Contacting faces 52, 53 of the wedge block 36 and wedge plate 46 are disposed in a plane that is at a relatively shallow angle of, for example, 10° off the vertical, but is otherwise transverse to the work station axis. The rearward face 51 of the wedge plate bears against a backing plate 54 which is fixed directly to the main body of the slide 13.

At a lower end, the wedge plate 46 has an inclined flat camming surface 61. A secondary wedge 62 riding on a lower plate 63 fixed to the slide 13 has a cam surface 64 that engages the wedge camming surface 61. The secondary wedge 62 is selectively driven horizontally towards or away from the cage plate 48 by a hydraulic actuator in the form of a rotary motor 66 fixed on the slide 13. A male spline 67 on the output shaft of the motor engages a complementary spline 68 of a rotary internally threaded "nut" 69 on an externally threaded jack screw 71. Axial thrust on the nut 69 is sustained by a bearing assembly 72. The forward end of the jack screw 71 is fixed to the secondary wedge 62. A gear 76 fixed to the nut 69 and a pinion 77 meshed with the gear 76 drive a shaft 78 in rotation proportional to the rotation of the nut 69. The shaft 78 has an acircular outside cross-section, e.g. square, so that it can drive a gear 79 through which it slides in a complementarily shaped bore. When the shaft 78 reciprocates with the slide 13, it slides through the gear 79 which remains axially fixed on the frame 11. The gear or pinion 79 meshes with another gear 81 on a rotary resolver 82 that generates electrical signals to record the position of the jack screw 71 and secondary wedge 62 as measured by the net angular rotation of the nut 69 from a reference angle.

Figure 3:
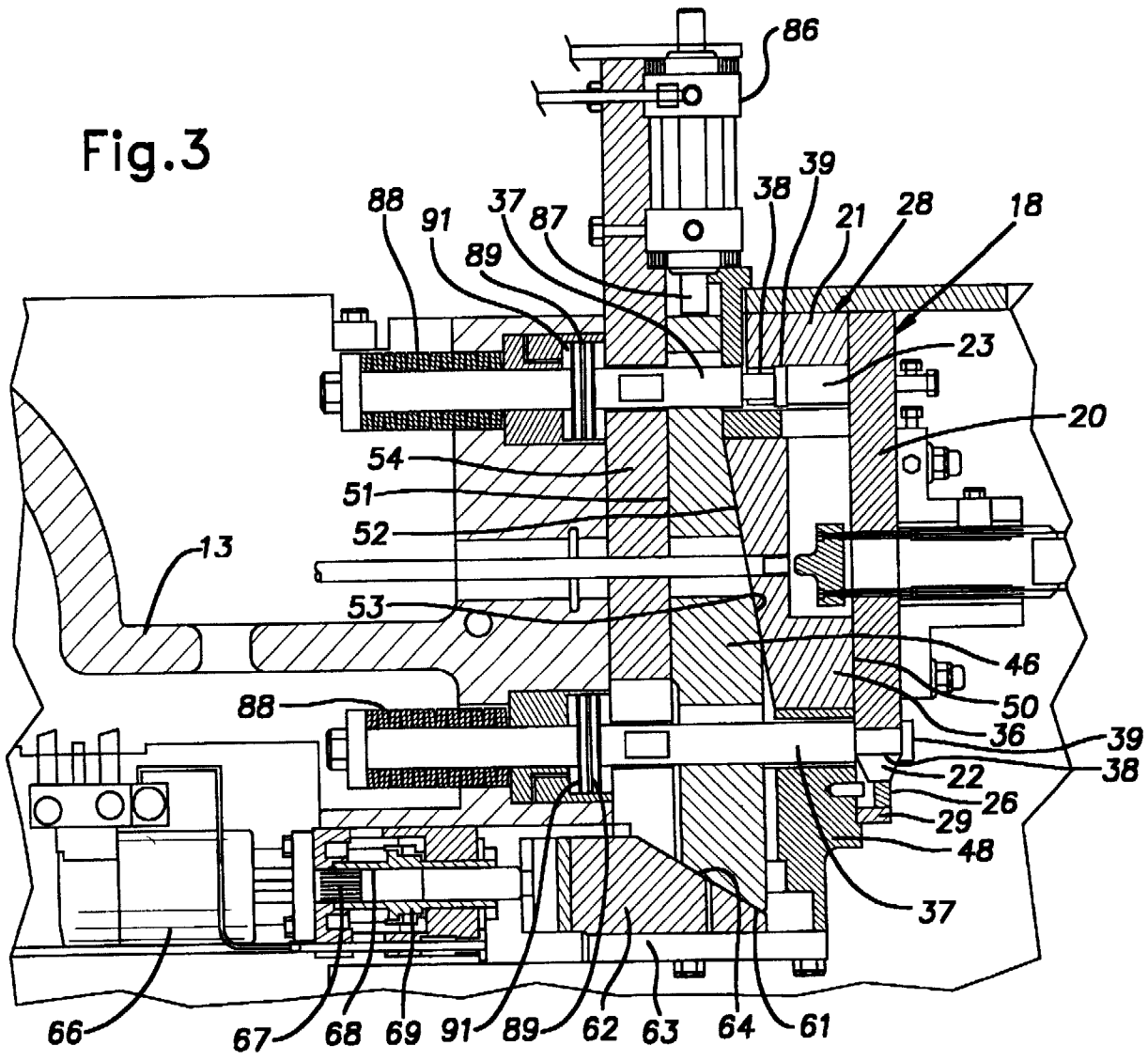
FIG. 3 is a cross-sectional fragmentary view of the machine taken in a vertical plane through the slide area.
Figure 3A:
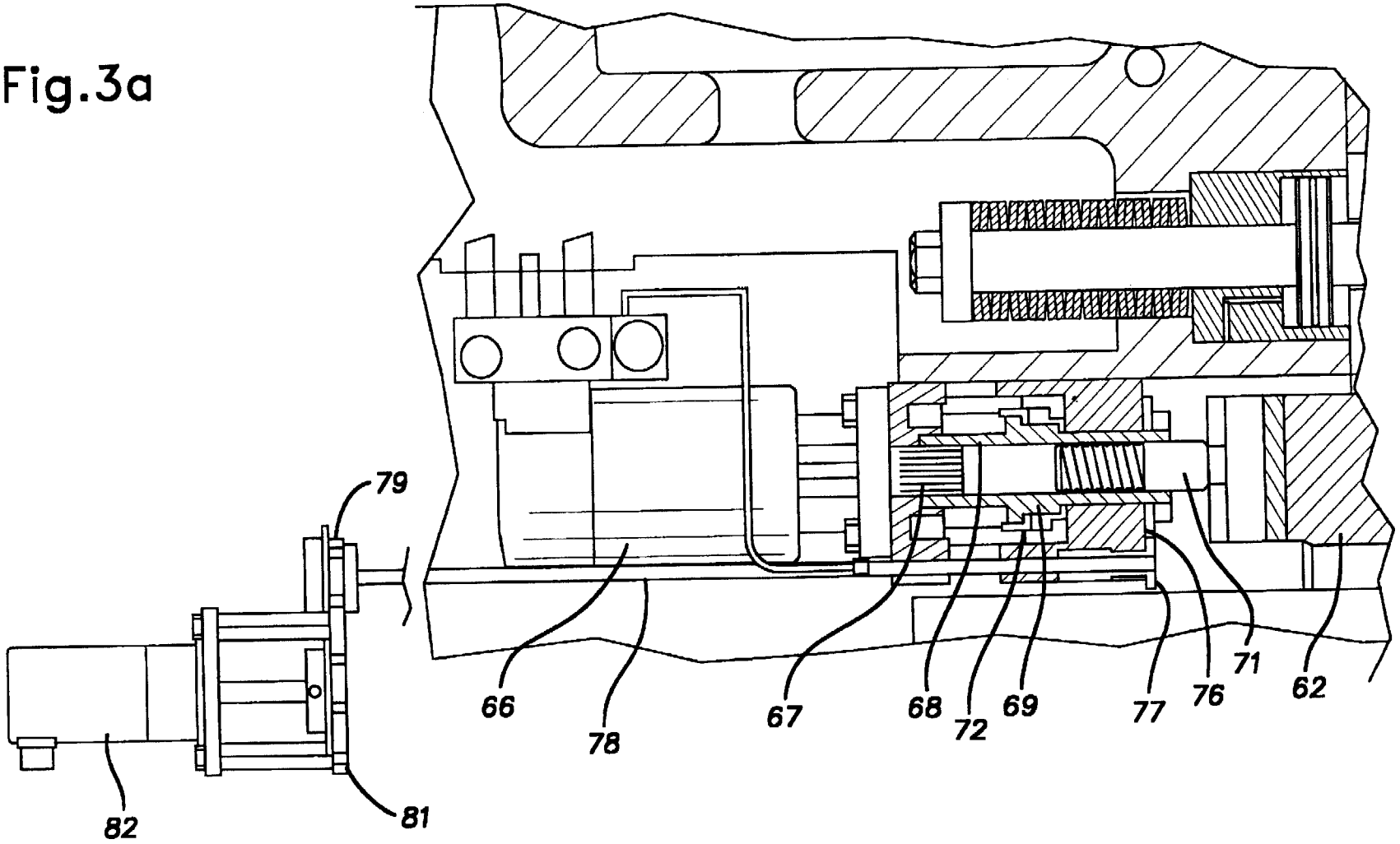
FIG. 3*a* is an enlarged cross-sectional view of a rotary hydraulic actuator and electronic resolver.
Figure 4:
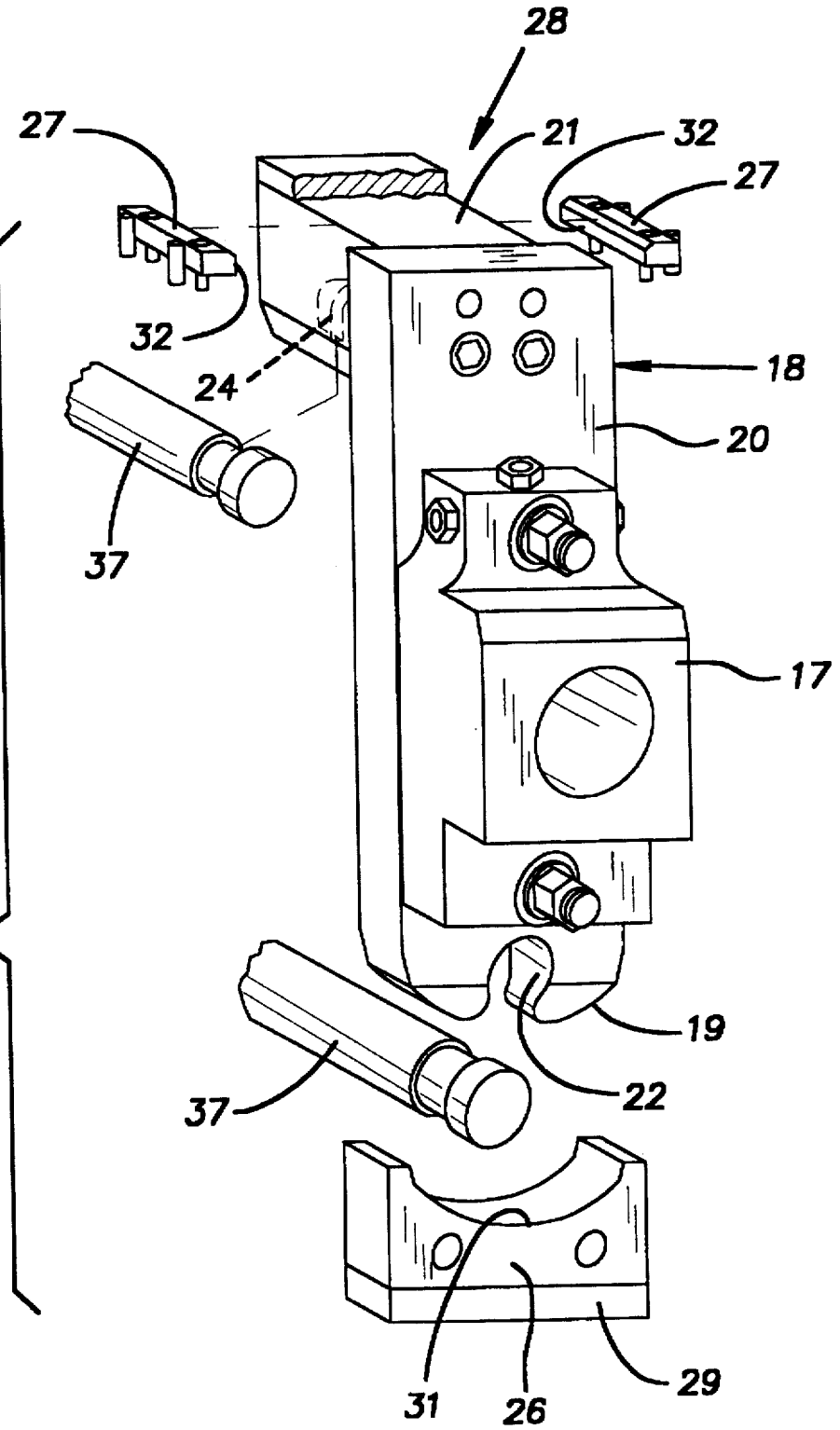
FIG. 4 is a perspective view of a tool cassette.
Figure 5:
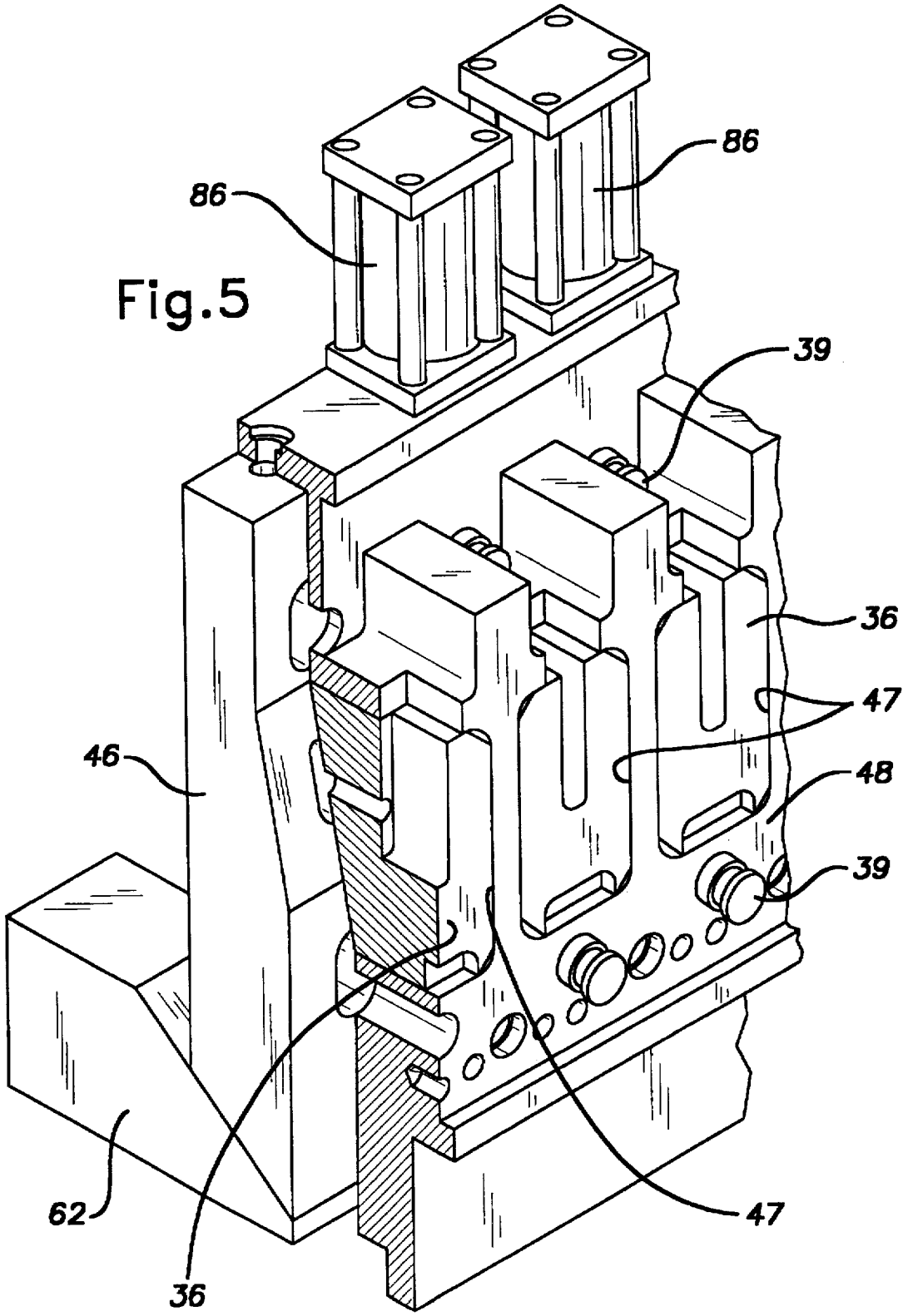
FIG. 5 is a fragmentary somewhat schematic perspective view of the front of the slide.

A hydraulic piston and cylinder actuator 86 mounted on the backing plate 54 has a vertically depending piston rod or ram 87 that is adapted to abut the upper end of the wedge plate 46 to drive this plate vertically downwardly when actuated. The clamp bars 37 are resiliently biased rearwardly to the left in FIG. 3 to a cassette clamping position by a pack of springs 88 retained on the rearward ends of the bars by nuts and washers. Each bar 37 has a piston 89 received in a hydraulic chamber 91. Pressurized hydraulic fluid selectively admitted to the chambers 91 by suitable controls overcomes the force of the springs to move the bars 37 to the right to release the cassette 18 and/or dwell in such position (rightward of that shown in FIG. 3) to receive a new cassette.

The described wedge elements 36, 46 and 62 and actuators 66 and 86 are typically duplicated at each work station 16*a–f*.

In operation, a tool cassette 18 carrying a tool holder or support 17 and a tool in the holder, which can be handled by a robotic arm, is received in a zone on the cradle 26 and between the blocks 27 when the clamp bars 37 are extended by hydraulic pressure in the chambers 91. Thereafter, the chambers 91 are exhausted to allow the springs 88 to securely clamp the cassette 18 against the wedge block 36.

At each work station 16*a–f* opposed complementary tooling on the die breast 12 and on the slide 13 is designed for a nominal shut height or minimum spacing between the die breast and slide. The disclosed apparatus allows the actual minimum spacing of opposed tools at each work station to be adjusted in the axial direction independently of such spacing at other work stations. The cassette 18 and associated tool holder 17 is moved on the slide 13 towards the die breast 12 by operation of the actuator 66 in a direction to drive the cam wedge 62 forwardly towards the die breast. This movement, by a camming action at the surfaces 61 and 64, causes the wedge plate 46 to rise and, in turn, wedging or camming action between the surfaces 52, 53 causes the wedge block 36 to extend towards the die breast 12. When the actuator 66 is operating to extend the wedge block 36 and cassette 18, the clamp release actuator formed by the piston 89 and chamber 91 may be energized or powered to unload all or part of the clamping force developed by the springs 88 and the ram actuator 86 can be energized or powered to retract the ram 87. The cassette 18 and tool carrier 17 are retracted on the slide from the die breast by reversing the direction of the hydraulic motor 66 to retract the secondary wedge or cam 62. To assure that any frictional resistance is overcome and that the wedge plate surface 61 follows the cam surface 64, the ram 87 is extended by powering the hydraulic piston and cylinder 86 to force the wedge plate 46 downwardly. The cassette lateral or radial positioning surfaces provided by the opposed blocks 27 and cradle 26, as mentioned, are parallel to the axial direction of the work station 16 so that they accommodate the adjustment motion developed by the secondary wedge 62 and the precise lateral positioning of the tool holder 17 afforded by these members is not disturbed. The resolver 82, by monitoring the revolutions of the jack screw nut 69, indicates the axial position of the wedge block 36 and cassette 18 to the controller of the machine 10 so that rotation of the motor 66 is discontinued when a desired adjusted location of the tool is obtained. The springs 88 are proportioned to provide adequate clamping force in any adjusted position of the wedge block 36.

The disclosed apparatus allows the actual minimum spacing of an opposed set of tools at a work station 16 to be adjusted in the axial direction. This adjustment can be used to correct for any inaccuracies in the original tool design or to account, for example, for thermally induced dimensional changes in the machine as it warms up and for changes in the wire stock condition. It will be understood that, according to the invention, the disclosed apparatus is capable of effecting the axial adjustment of the individual tools advantageously "on the fly" while the machine is operating and forging parts. It will be appreciated that the disclosed machine affords complete flexibility in the adjustment of the shut height of a tool pair at any given work station 16*a–f*

We claim:

1. In a progressive forging machine having a die breast and a slide that reciprocates towards and away from the die breast, the die breast and slide having a plurality of opposed aligned work stations for carrying cooperating tools, power operated mechanism for adjusting each tool on the slide axially in a direction parallel to the direction of slide movement independently of the axial position of the other tools and maintaining the lateral alignment of a tool being axially adjusted with the associated opposed tool, a tool support at each work station on the slide, each tool support being located by precision located surfaces, said surfaces being in planes parallel to the axial direction of the work station, said tool support being in the form of a tool holder cassette and said slide including a power operated clamp for clamping said tool cassette thereon, and wherein said machine includes a separate load bearing block associated with each work station on the slide.

2. A forging machine as set forth in claim 1, including a wedge surface responsive to motion lateral of said axial direction for producing axial motion of said load bearing block.

3. A forging machine as set forth in claim 2, including a secondary wedge for producing said lateral motion.

4. A forging machine as set forth in claim 2, including a power operated screw for driving said wedge surface.

5. A forging machine as set forth in claim 3, including power actuator members for driving said wedge surface in opposite lateral directions.

6. A forging machine as set forth in claim 5, including a hydraulic piston and cylinder actuator for moving said wedge surface in one direction.

7. A forging machine as set forth in claim 4, wherein said power operated screw includes a rotary hydraulic motor capable of driving said wedge surface on the fly during production operation of said forging machine.

8. A forging machine as set forth in claim 4, wherein said power operated screw is arranged to forcibly displace a secondary wedge, said secondary wedge being arranged to produce said lateral motion.

9. A progressive forging machine having a die breast and a slide that reciprocates towards and away from the die breast, a plurality of opposing work stations on the slide and the die breast, a separate load bearing block on the slide associated with each work station, a tool support in the form of a tool holder cassette axially located on each slide work station in lateral alignment with reference to an axial direction parallel to the direction of slide movement with respect to an opposed die work station on the die breast, power operated means for separately adjusting the axial location of each of said load bearing blocks and the associated tool support cassette, locating surfaces for precisely positioning the tool support cassette at each work station so that it is in alignment with an opposing work station on the die breast and being arranged to permit axial adjustment of the associated bearing block and tool support cassette while maintaining the alignment of the tool support cassette relative to its opposed die breast work station, and a device to automatically clamp each load bearing block and the associated tool support cassette in an adjusted position, and wherein said machine includes a separate load bearing block associated with each word station on the slide.

* * * * *

UNITED STATES PATENT AND TRADEMARK OFFICE

CERTIFICATE OF CORRECTION

PATENT NO. : 5,704,245

DATED : January 6, 1998

INVENTOR(S) : Richard J. McClellan et al.

It is certified that error appears in the above-indentified patent and that said Letters Patent is hereby corrected as shown below:

Column 4, line 49, after "16a-f" insert the following:

--independently of the adjustment that may be made at another work station. As a result, more uniform parts can be manufactured by the machine and tool service life can be improved.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.--

Signed and Sealed this

Second Day of June, 1998

Bruce Lehman

*Attest:*

BRUCE LEHMAN

*Attesting Officer*

*Commissioner of Patents and Trademarks*